United States Patent [19]

Pierce

[11] Patent Number: 4,989,746

[45] Date of Patent: Feb. 5, 1991

[54] RESEALABLE CONTAINER CLOSURE SYSTEM

[76] Inventor: Thomas W. Pierce, 3045 New Castle Dr., Marietta, Ga. 30064

[21] Appl. No.: 398,000

[22] Filed: Aug. 24, 1989

[51] Int. Cl.[5] ..... B65D 51/18

[52] U.S. Cl. ..... 220/254; 220/331; 220/335; 220/344; 220/90.4

[58] Field of Search ..... 220/90.2, 90.4, 244, 220/254, 334, 335, 343, 344

[56] References Cited

U.S. PATENT DOCUMENTS

| | | | |
|---|---|---|---|
| 3,967,748 | 7/1976 | Albert | 220/90.4 |
| 4,057,167 | 11/1977 | Lee | 220/90.4 |
| 4,127,212 | 11/1978 | Waterbury | 220/254 |
| 4,170,724 | 10/1979 | Waterbury | 220/254 X |
| 4,232,797 | 11/1980 | Waterbury | 220/359 |
| 4,244,488 | 1/1981 | Fridl et al. | 220/260 |
| 4,386,714 | 6/1983 | Roberto et al. | 220/339 |
| 4,407,423 | 10/1983 | Walter | 220/260 |
| 4,407,424 | 10/1983 | Heyn | 220/269 |
| 4,516,689 | 5/1985 | Barker | 220/335 |
| 4,819,829 | 4/1989 | Rosten et al. | 220/346 |

*Primary Examiner*—Stephen P. Garbe
*Assistant Examiner*—Nova Stucker
*Attorney, Agent, or Firm*—Louis T. Isaf

[57] ABSTRACT

A resealable closure system for use on a container comprising an insert and a removable plug to seal an opening in the insert; the plug has a soft, hollow bottom that is shaped to fill the insert opening and which functions to provide one or more sealing opportunities; and, in the preferred embodiment, this plug is linked to the insert at one end by a pair of hinge arms which serve to guide the plug through a proscribed range of motion as it is inserted into or removed from the insert opening.

32 Claims, 3 Drawing Sheets

RESEALABLE CONTAINER CLOSURE SYSTEM

FIELD OF THE INVENTION

This invention relates generally to the field of container closure systems and particularly to the field of resealable plug type container closure mechanisms.

BACKGROUND OF THE INVENTION

There are a number of plug type container closure systems in use today. Most are manufactured with the container and are designed to be opened easily, used once, discarded along with the container, and perhaps recycled. Some other considerations often mentioned for this type of "flip top" closure system are: a desire to provide a secure yet easily opened seal, to ensure that contents are accessible but not accidentally so; a desire to keep the plug member attached to the container after the container is opened, to prevent littering; and a desire to keep all exposed edges rounded, to prevent cuts.

Some closure systems are designed to be resealable, such as U.S. Pat. No. 4,232,797 which provides a plastic plug thermoformed to overlap the inner and outer surfaces of a container wall to seal an opening therein. After removing the plug from the container opening, the plug can be snapped back into place, which should serve to reseal the container opening. The quality of this seal and whether it can be repeatedly achieved is open to question.

SUMMARY OF THE INVENTION

Briefly described, the closure system of the present invention comprises a closure mechanism mounted on an opening of a container. The closure mechanism of this system comprises a plug and an insert. The insert is mounted on the opening in the container and there is a passageway through the insert into which the plug fits. The plug is unique because it includes a rigid top and a soft, hollow bottom. This soft bottom provides a safe, secure closure when the plug is used to reseal the passageway. A gasket beneath the rigid plug top provides another sealing means when the plug top is held tightly against the insert passageway. The entire closure mechanism is potentially removable from the container and reusable.

In preferred embodiments, an insert attached to one container wall includes a passageway extending through it from the outside to the inside of the container. The plug bottom in these embodiments is shaped to cooperate with the contours of the insert wall defining this passageway; a tight seal is formed when the plug is inserted therein. The primary seal is effected by a bead and channel combination; a second cooperative seal is effected by the spreading of the plug bottom against the passageway as pressure inside the can increases, caused, for example, by the carbonation found in some beverages. This effect is enhanced by partially evacuating the hollow interior of the plug bottom.

In the preferred embodiment, releasing and resealing the plug and container are accomplished by the combination of the plug structure and a hinging arm structure which is used to guide the plug through a defined movement path, assuring that the plug bottom seals securely with the insert wall.

It is therefore an object of the present invention to provide a resealable closure mechanism for a container which is easily opened and which forms a positive seal against leakage or contamination for each and every subsequent closure.

Another object of the present invention is to provide a closure mechanism which seals through several cooperative means.

Still another object of the present invention is to provide a closure system which will have a tamper evident seal to protect the consumer from purchasing an impure product.

Another object of the present invention is to provide a closure mechanism which is reusable by the manufacturer on multiple containers.

Yet another object of the present invention is to provide a closure system which has no separately discardable parts. That is, all parts of the closure mechanism remain attached to the container in both the closed and the open positions.

Other objects, features and advantages of the present invention will become apparent upon reading and understanding this specification, taken in conjunction with the accompanying drawings.

Detailed Description

Figure 1:
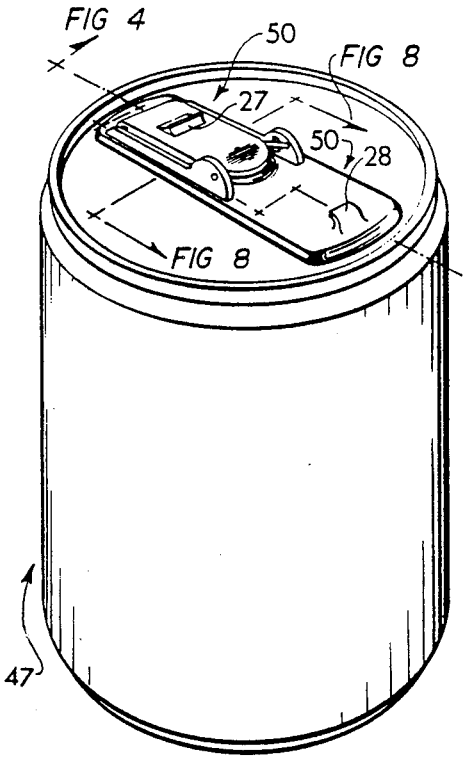
FIG. 1 is a perspective view of a container closure system in accordance with the present invention, the closure system being shown in the closed position.

Referring now in greater detail to the drawings, in which like numerals represent like components throughout the several views, FIG. 1 depicts a resealable container closure system of the present invention as including a container 47 and closure mechanism 50. A preferred embodiment of the closure mechanism 50 of the present invention is seen in FIGS. 1–9 as including a plug top 13, a plug bottom 35 and an insert top 11. The insert top 11 is attached to an opening (not shown) in the wall of a container 47 by joining the insert top to an insert bottom 12. The insert top 11 includes a passageway 30 (see FIG. 6), defined by an inner wall 31, through which the contents of the container can be poured. The plug bottom 35 is designed to cooperate closely with the inner wall 31, when the plug bottom is inserted into the passageway 30, forming a tight seal for the container, as more clearly described below.

The plug top 13 includes a leading end 48 and a trailing end 49, each end having an edge, 21 and 26 respectively. A grip surface 22 on the top surface of leading end 48 and a thumb grip 27 on the top surface of trailing end 49 aid in opening and closing. Hinge pins 16*a,b* (see FIG. 7) are used to link the leading end 48 of the plug top 13 to the insert top 11, and guide pins 15*a,b* are used to link the trailing end 49 of the plug top 13 to the insert top 11. The plug top 13 will preferably overlap the passageway 30 outside the insert top 11. In one example, the overlap is 3–5 mm on all sides except for the leading edge 21, where the overlap will be slightly greater. A sealing gasket 32 is mounted directly to the underside of this overlapping area of the plug top 13.

Figure 2:
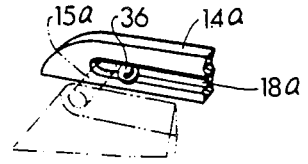
FIG. 2 is an isolated view of the closure system of FIG. 1 showing the relative positioning of various members in greater detail.

The insert top 11 includes hinge arm sockets 19*a,b* and plug guides 14*a,b*. Tracks 18*a,b* arc formed in the plug guides 14*a,b* respectively and these tracks 18*a,b* work in conjunction with the aforementioned guide pins 15*a,b*. Keepers 20*a,b* (see FIG. 5) protrude slightly out from one side of their respective plug guides 14*a,b*, each toward the other. Tamper evident beads 36*a,b* are shown in FIG. 2; these beads are attached to the tracks 18*a,b* during manufacture. As the plug top 13 is moved to the open position for the first time, the movement of the guide pins 15*a,b* breaks these beads away from the tracks 18*a,b*, and their absence indicates that the container has been opened previously. These beads 36*a,b* are preferably placed adjacent to guide pins 15*a,b* to serve a secondary function of holding the guide pins in the closed position prior to the first opening. A finger depression 25 is located on the insert top 11 to aid in gripping the leading end 48 of the plug top 13. A fastening socket 24 on the insert top 11 works in conjunction with a fastening ball 23 on the plug top 13 to hold the plug top in the closed position (see FIG. 7). A plug stop 28 is used to hold the plug bottom 35 in the open position (see FIGS. 6 and 9). Instead of the tamper evident beads 35*a,b*, an alternate embodiment includes tamper evident tape 52 (see FIG. 10).

Figure 3:
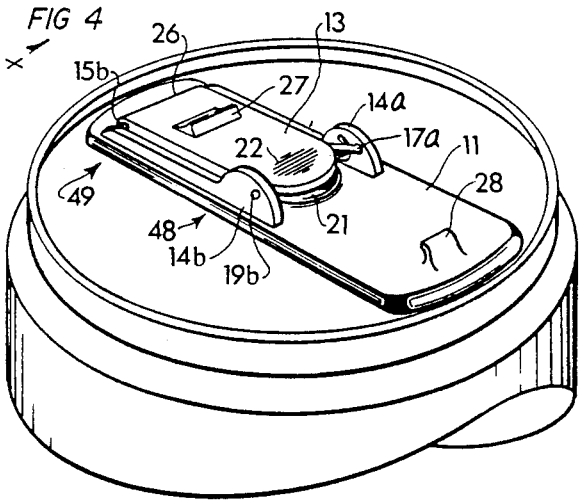
FIG. 3 is an enlarged view of the closure system of FIG. 1 in the closed position.
Figure 4A:
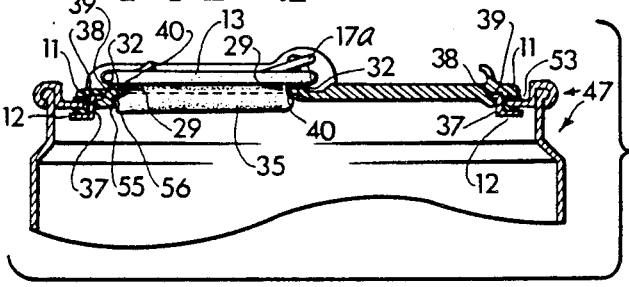
FIG. 4A is an enlarged isolated view of the sectional view taken along view 4—4 of FIG. 1.
Figure 4:
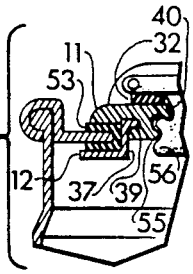
FIG. 4 is a sectional view taken along view 4—4 of FIG. 1.
Figure 6:
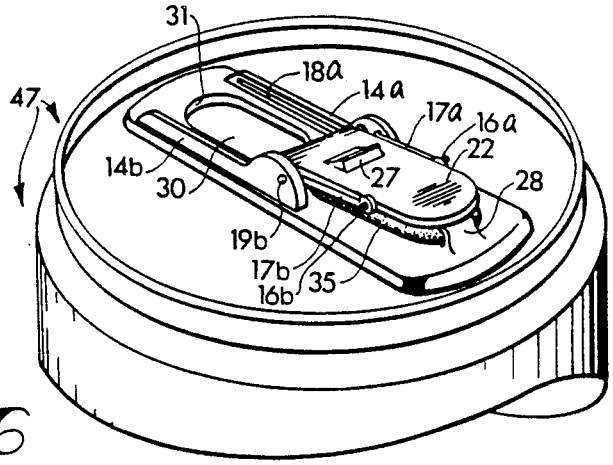
FIG. 6 is an enlarged view of the closure system of FIG. 1 illustrating the opened position.
Figure 7:
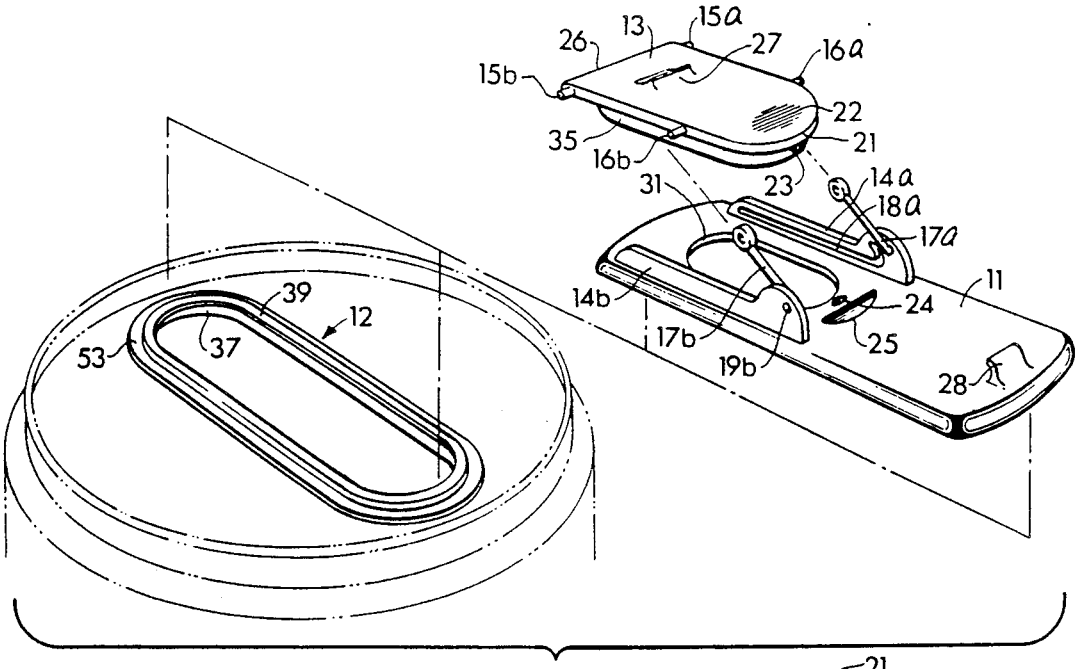
FIG. 7 is an exploded view of the closure system of FIG. 1 showing the relative positioning of various members in greater detail.

Another feature of the preferred embodiment is the linkage between the plug top 13 and the insert top 11 (see FIGS. 4 and 7). A pair of hinge arms 17*a,b* pivotally mounted to hinge arm sockets 19*a,b*, link the leading end 48 of the plug top 13 to the insert top 11. In the preferred embodiment, the hinge pins 16*a,b* are located at a point near the leading end 48 of the plug top 13, approximately one-third of the distance between the leading edge 21 and the trailing edge 26 of the plug top. The trailing edge 26 of the plug top 13 is linked to the insert top 11 by the pair of guide pins 15*a,b* that are slidably mounted to tracks 18*a,b* in plug guides 14*a,b*. This linkage, comprised of the hinge arms 17*a,b*, plug guides 14*a,b*, and guide pins 15*a,b*, ensures that the plug will be moved from a first position shown in FIG. 3 through a predefined path to a second position illustrated in FIG. 6.

Figure 10:
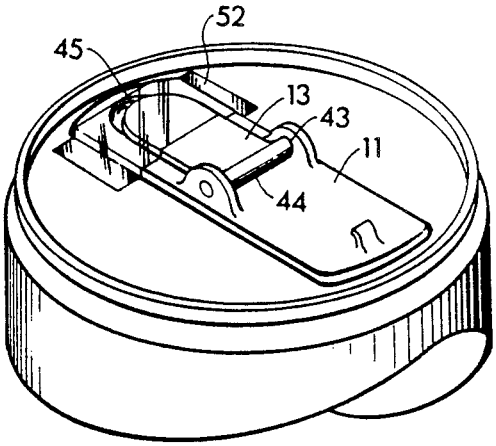
FIG. 10 is an enlarged view of a container top with a closure system in accordance with the present invention, shown in the closed position, and showing an alternate embodiment to that of FIG. 1.
Figure 11:
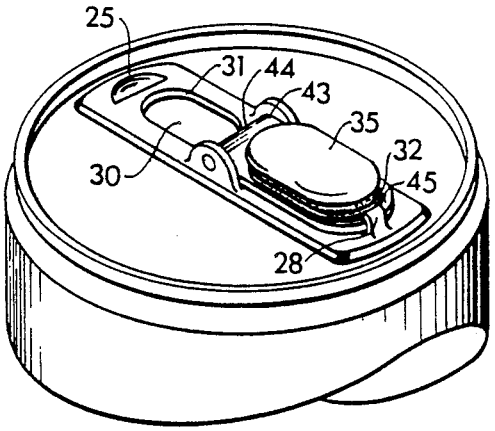
FIG. 11 is an enlarged view of the closure system of FIG. 10 illustrating the open position.

A second embodiment of the present invention as illustrated in FIGS. 10 and 11 relies on a different linkage and opening movement. This embodiment utilizes a hinge 43 to mount a pivot end 44 of the plug top 13 to the insert top 11. A grip end 45 of the plug top 13 is moved through an arcuate path to move the plug top 13 from a first closed position shown in FIG. 10 to a second open position shown in FIG. 11.

In the first embodiment, illustrated in FIG. 4, the insert top 11 is shown attached to the top wall of the container 47. The insert bottom 12 is employed to secure the insert top 11 to the wall of the container 47 and serves to make the seal between the insert top and the opening in the wall of the container airtight as well. In this embodiment both the insert top 11 and the insert bottom 12 overlap the wall of the container 47 at the edge of the opening therein, most preferably by at least 1 cm.

The insert bottom 12 is preferably attached to the inside of the container wall by means of an airtight adhesive. The non-toxic adhesive chosen for this is preferably non-water soluble, such as a proper form of styrane-butadiene or a thermoplastic polymide, but is preferably readily soluble with solvents such as naptha or ether during recycling so the entire closure mechanism can be removed and attached to another container.

The insert bottom 12 includes an upwardly extending flange 37 which fits the container opening snugly, protrudes through the opening in the wall of the container 47 and locks into a corresponding flange channel 38 on the underside of the insert top 11 (see FIGS. 4, 7, 8 and 9). The insert bottom 12 is joined to the insert top 11 with the same adhesive used to join the insert bottom 12 to the wall of the container 47. A second gasket 53 (see FIG. 7) is used in the preferred embodiment to wrap around the opening in the wall of the container 47 to improve the seal between container 47, insert top 11, and insert bottom 12. In an alternate embodiment, the airtightness and strength of this union is enhanced by adding a flared flange bead 39 of malleable plastic around the top of the flange 37 before joining the flange 37 to the insert top 11 at the flange channel 38.

In an alternate embodiment, the insert top 11 serves as a large portion of the container itself. For example, in one alternate embodiment, the insert top 11 is used as the entire top portion of a beverage can. In this embodiment there is no need for the insert bottom 12 or for the flange 37, flange bead 39, second gasket 53 and flange channel 38 just discussed, and the top portion is physically removed from the container before being recycled by dissolving the adhesive which joins it to the body of the container.

Figure 8:
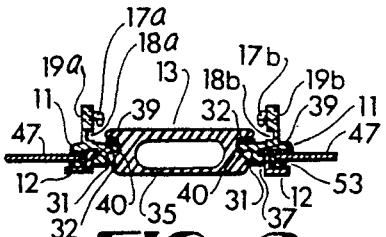
FIG. 8 is a sectional view taken along view 8—8 of FIG. 1.

The plug top 13 and the insert top 11 in the preferred embodiment are composed of a rigid material, for example, a hard plastic. The plug bottom 35 is preferably composed of a softer, more flexible material. The diameter of the plug bottom 35 is narrowed just below the plug top 13 into a channel 29 as shown in FIGS. 4 and 8. The preferred embodiment also includes a corresponding constricted region, at the upper diameter of the insert inner wall 31, which forms a bead 40.

Figure 9:
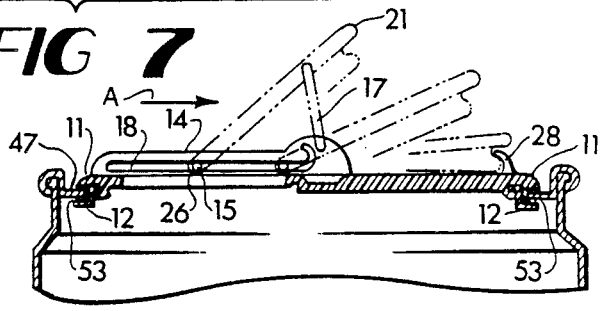
FIG. 9 is an isolated side view of the closure system of FIG. 1, with parts broken away for clarity, illustrating the system as it moves between the closed and open positions.
Figure 12:
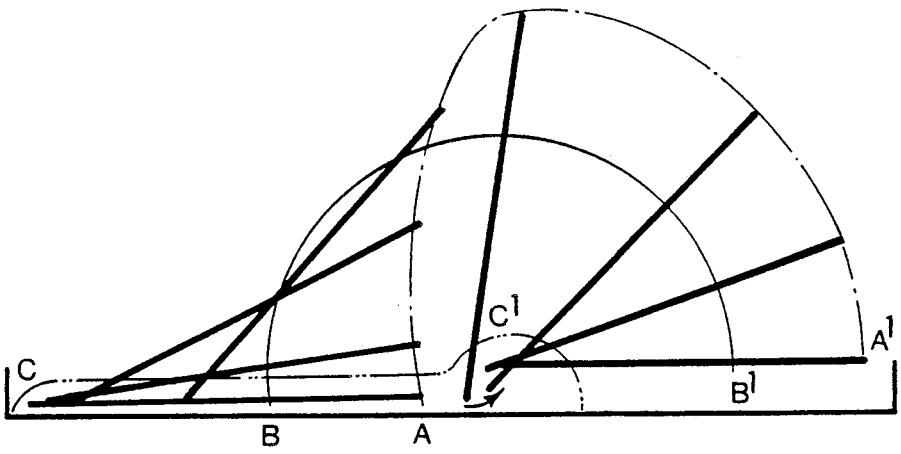
FIG. 12 is a vector diagram illustrating the movements of the components of the closure system of FIG. 1, as they move between the closed and open positions.

In the preferred embodiment, the channel 29 is deeper beneath the trailing end 49 of the plug top 13 in order to facilitate the action of the hinge arms 17*a,b*. As shown in FIGS. 9 and 12, the trailing end 49 of the plug top 13 is moved a maximum distance away from the hinge arm sockets 19*a,b* when the hinge arms 17*a,b* are parallel to the plug top 13. Thus, as the plug top 13 passes this position and locks down into the closed position, its motion is also slightly toward the hinge arm sockets 19*a,b*. This motion assists in the development of a stronger seal between the channel 29 and bead 40. Conversely, in the opening motion of the preferred embodiment, the leading end 48 of the plug top 13 moves slightly back and away from the adjacent inner wall 31, making it easier to break the seal of the plug bottom 35 with the insert inner wall 31 in the area adjacent to the plug top leading end 48.

In the preferred embodiment, the plug bottom 35 is slightly larger than the opening defined by the bead 40 of the inner wall 31 so that any internal pressure from the contents of the container, such as from a carbonated beverage, will tend to reform the plug bottom 35 around the bead 40 to tighten, rather than loosen, the seal of the plug bottom 35 with the insert inner wall 31. This effect is enhanced by reducing the pressure inside the plug bottom 35, which is hollow, when it is manufactured.

Figure 5:
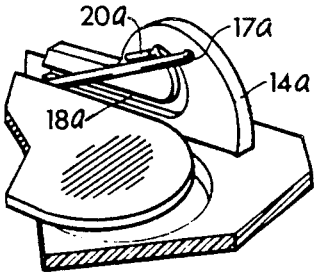
FIG. 5 is an isolated view of the closure system of FIG. 1 showing the relative positioning of various members in greater detail.

Positive closure features of the preferred embodiment include a knob 55 and dimple 56, keeper means 20*a,b*, and the fastening ball 23 and socket 24 (see FIGS. 3, 5 and 7). The knob 55, located on the insert inner wall 31, protrudes slightly and fits snugly into the dimple 56 located on the plug bottom 35 near the trailing end 49. The knob and dimple assure proper vertical alignment of the plug bottom 35 with the insert inner wall 31. Keeper means 20*a,b* extend out slightly from their respective plug guides 14*a,b* and help hold the hinge arms 17*a,b*, and consequently the plug top 13, in the closed position. The fastening ball 23 and socket 24 of the preferred embodiment also ensure that the plug top 13 locks securely down into the closed position. In alternate embodiments, other types of fasteners, for example velcro, work equally well for this purpose, and replace the ball 23 and socket 24 combination.

The paths followed by the leading edge 21, the hinge pins 16*a,b*, and the guide pins 15*a,b* are shown in FIG. 12. Path A to A′ shows the path followed by the leading edge 21 of the plug top 13 as it moves from the closed to the open position; path B to B′ shows the arcuate path followed by the hinge pins 16*a,b* (and thus the leading end 48); and path C to C′ similarly shows the path of the guide pins 15*a,b* (and thus the trailing end 49) as they move from the closed to the open position. Each straight line in this figure represents an orientation of the plug top 13 as it is moved between the closed and the open position.

Use

Before opening the preferred embodiment of the container closure system for the first time, the tamper evident seals 36 and 52 must be broken. The user first inserts his index finger under the leading edge 21 of the plug top 13 where there is a finger depression 25 in the insert 11 and lifts this leading end 48 of the plug top 13 away from the insert 11. As the leading end 48 is being lifted, the user's thumb is used to push against the thumb grip 27 on the trailing end 49 of the plug top 13 in the direction of arrow "A" of FIG. 9 until the hinge arms 17*a,b* are in a position perpendicular to the tracks 18*a,b* (see FIGS. 7, 8, 9, and 12). The guide pins 15*a,b* will slide in a straight line along the tracks 18*a,b* as the hinge arms 17*a,b* pivot radially about the hinge arm sockets 19*a,b* during this motion.

Once the hinge arms 17*a,b* reach the above stated perpendicular position, a slight pressure applied to the finger grip 22 toward the insert 11 will move the plug leading end 48 to its open position, shown in FIG. 6, where the plug bottom 35 wedges against the plug stop 28 to hold the plug in the open position. During this motion, the tracks 18*a,b* will guide the plug top trailing end 49 through a path which curves up to and then slightly past the vertical, which ensures that the lower edge of the plug bottom 35 will rise up and then be held above the insert 11.

To reclose the container, the user's finger is placed under the leading edge 21 of the plug top 13 and lifted to disengage the plug bottom 35 from the plug stop 28. By lifting the leading edge 21, the leading end 48 is pulled away from the insert 11 until the hinge arms 17*a,b* are once again perpendicular to the tracks 18*a,b*. The leading end 48 is then pushed toward the insert 11, which has the effect of moving the trailing end 49 along the tracks 18*a,b* (in the reverse direction of arrow "A" of FIG. 9) until the channel 29 is firmly seated against the bead 40 in the area adjacent to the trailing end 49. As the hinge arms 17*a,b* reach and pass through a position parallel to the tracks 18*a,b*, the motion of the trailing end 49 halts and then reverses to once again be in the direction of arrow "A". By this time, the leading end 48 of the plug bottom 35 has dropped into the insert opening and this motion helps to seat the channel 29 with the bead 40 at this end of the plug.

Whereas the present invention has been described in detail with specific reference to particular embodiments thereof, it will be understood that variations and modifications can be effected within the spirit and scope of the present invention as hereinbefore described and as defined in the appended claims.

I claim:

1. A resealable closure system for use on a container, which container includes at least an opening defined in a wall of the container, said closure system comprising:

an insert for mounting to the container wall within the opening, said insert including, at least, top and bottom surfaces and an inner wall forming a passageway which extends from said insert top surface to said insert bottom surface, said passageway including, at least, a bead protruding therefrom;

plug means for sealing said passageway, said plug means including, at least, a soft plug portion, said soft plug portion comprising, at least, a channel formed therein;

linkage means for holding said plug means alternately between a first position, with said soft plug portion inserted into said passageway, which seals said passageway, and a second position, with said soft plug portion removed from said passageway, which does not seal said passageway, said channel of said soft plug portion interlocking with said bead of said passageway when said plug means is in said first position, whereby a seal is formed between the soft plug portion and said passageway.

2. Closure system of claim 1, wherein said soft plug portion further comprises, at least, a hollow plug bottom formed from a flexible material into a shape cooperating with said inner wall to seal said passageway when said plug means is in said first position.

3. Closure system of claim 2, wherein said hollow plug bottom is reformable, as by pressure from inside the container, to engage closely with said inner wall, whereby an additional seal is provided.

4. Closure system of claim 1, wherein said linkage means comprises, at least, a pivot hinge connecting said plug means to said insert.

5. Closure system of claim 1, wherein said plug means further comprises, at least, a top plug portion constructed so as to overlap said passageway when said plug means is held in said first position and a sealing gasket mounted under said top plug portion to further seal said passageway when said plug means is held in said first position.

6. Closure system of claim 1, wherein said plug means has a leading end and an opposite trailing end, and wherein said linkage means comprises, at least:

a first path defining means for guiding said plug means leading end; and a second path defining means for guiding said plug means trailing end.

7. Closure system of claim 6, wherein:

said first path defining means includes, at least, two hinge arms, each mounted between said plug top leading end and said insert;

said second path defining means includes, at least, two elongated plug guides attached to said insert on opposite sides of said passageway;

a track in each plug guide; and guide pins mounted to said plug top trailing end, each guide pin positioned to engage with one of said tracks.

8. Closure system of claim 7, further comprising keeper means for holding said plug means in said first position.

9. Closure system of claim 1, wherein said insert comprises, at least, a top portion and a bottom portion, said insert bottom portion releasably attachable to said insert top portion to mount said insert to the container wall by clamping the container wall between said insert top portion and said insert bottom portion.

10. Closure system of claim 9, wherein said insert further comprises, at least:

a flange channel in said insert top portion; and a flange corresponding to said flange channel, extending up from said insert bottom portion, so as to interact with said flange channel during mounting on the container wall.

11. Closure system of claim 10, wherein said insert further comprises, at least, a gasket separating said insert top portion and said insert bottom portion from the container.

12. Closure system of claim 1, further comprising:

a knob extending out from said inner wall of said insert; and a concave dimple on said soft plug portion located so as to engage with said knob when said plug means is in said first position.

13. Closure system of claim 1, further comprising fastening means for holding said plug means in said first position.

14. In combination:

a container including at least a wall;

an opening defined in said wall of said container;

an insert mounted to said container wall within the opening, said insert including, at least, top and bottom surfaces and an inner wall forming a passageway which extends from said insert top surface to said insert bottom surface, said passageway including, at least, a bead protruding therefrom;

plug means for sealing said passageway, said plug means including, at least, a soft plug portion, said soft plug portion comprising, at least, a channel formed therein; and linkage means for holding said plug means alternately between a first position which seals said passageway and a second position which does not seal said passageway, said channel of said soft plug portion interlocking with said bead of said passageway when said plug means is in said first position, whereby a seal is formed between the soft plug portion and said passageway.

15. A method for moving a plug between a first position within a passageway and a second position outside of and beside the passageway, wherein the passageway defines a plane, said method comprising the steps of:

lifting a first end of the plug above the plane defined by the passageway;

moving a second, opposite end of the plug in a first linear direction parallel to the plane defined by the passageway while still performing the lifting step; and guiding the first end of the plug through an arcuate path in a first angular direction, above and about an axis lying parallel to the plane defined by the passageway, thus lifting the plug up and across the passageway to the second position beside the passageway.

16. Method of claim 15, further comprising the step of moving the plug slightly in the reverse of the first linear direction as the first end of the plug is initially lifted above the plane defined by the passageway.

17. Method of claim 25, further comprising the steps of:

guiding the first end of the plug back through the arcuate path in a direction opposite the first angular direction, while performing the step of guiding the first end in a direction opposite the first angular direction, moving the second, opposite end of the plug in a direction opposite to the first linear direction, at least until the second, opposite end of the plug abuts the side of the passageway; and moving the first end of the plug toward the plane defined by the passageway and into the passageway.

18. Method of claim 17, further comprising the step of moving the second opposite end of the plug slightly in the first linear direction after moving the first end of the plug toward the plane defined by the passageway and into the passageway.

19. Method of claim 15, further comprising the step of, simultaneously, while the first end of the plug is guided through an arcuate path in a first angular direction above and about an axis lying parallel to the plane defined by the passageway, lifting the second, opposite end of the plug in a second direction away from the plane defined by the passageway.

20. A resealable closure system for use on a container, which container includes at least an opening defined in a wall of the container, said closure system comprising:

an insert for mounting to the container wall within the opening, said insert comprising, at least:

an insert top portion, said insert top portion including, at least, top and bottom surfaces and an inner wall forming a passageway which extends from said top surface to said bottom surface, said passageway including, at least, a bead protruding therefrom, said insert top portion also including, at least, a flange channel therein; and an insert bottom portion, said insert bottom portion releasably attachable to said insert top portion to mount said insert to the container wall by clamping the container wall between said insert top portion and said insert bottom portion, said insert bottom portion including, at least, a flange corresponding to said flange channel of said insert top portion and extending up from said insert bottom portion so as to interact with said flange channel during mounting on the container wall;

plug means for sealing said passageway, said plug means being movable between a first position which seals said passageway and a second position which does not seal said passageway, said plug means including, at least, a leading end, an opposite, trailing end, a top plug portion constructed so as to overlap said passageway when said plug means is held in said first position, and a soft plug portion, said soft plug portion comprising, at least, a channel formed therein, said channel of said soft plug portion interlocking with said bead of said passageway when said plug means is in said first position, whereby a seal is formed between the soft plug portion and said passageway, linkage means for holding said plug means alternately between said first position which seals said passageway and said second position which does not seal said passageway, said linkage means comprising, at least:

a first path defining means for guiding said plug means leading end, said first path defining means including, at least, two hinge arms, each mounted between said plug top leading end and said insert;

a second path defining means for guiding said plug means trailing end, said second path defining means including, at least, two elongated plug guides attached to said insert on opposite sides of said passageway;

a track in each plug guide;

guide pins mounted to said plug top trailing end, each guide pin positioned to engage with one of said tracks.

21. Closure System of claim 20, further comprising:

a sealing gasket mounted under said top plug portion to further seal said passageway when said plug means is held in said first position;

keeper means for holding said plug means in said first position;

a gasket separating said insert top portion and said insert bottom portion from the container;

a knob extending out from said inner wall of said insert; and a concave dimple on said soft plug portion located so as to engage with said knob when said plug means is in said first position.

22. A resealable closure system for use on a container, which container includes at least an opening defined in a wall of the container, said closure system comprising:

an insert for mounting to the container wall within the opening, said insert including, at least, top and bottom surfaces and an inner wall forming a passageway which extends from said insert top surface of said insert bottom surface, said passageway including, at least, a bead protruding therefrom;

plug means for sealing said passageway, said plug means including, at least, a soft plug portion, said soft plug portion comprising, at least, a channel formed therein;

linkage means for holding said plug means alternately between a first position which seals said passageway and a second position which does not seal said passageway, said channel of said soft plug portion interlocking with said bead of said passageway when said plug means is in said first position, whereby a seal is formed between the soft plug portion and said passageway; and said soft plug portion further comprising, at least, a hollow plug bottom formed from a flexible material into a shape cooperating with said inner wall to seal said passageway when said plug means is in said first position, wherein said hollow plug bottom is reformable, as by pressure from inside the container, to engage closely with said inner wall, whereby an additional seal is provided.

23. A resealable closure system for use on a container, which container includes at least an opening defined in a wall of the container, said closure system comprising:

an insert for mounting to the container wall within the opening, said insert including, at least, top and bottom surfaces and an inner wall forming a passageway which extends from said insert top surface to said insert bottom surface, said passageway including, at least, a bead protruding therefrom;

plug means for sealing said passageway, said plug means including, at least, a soft plug portion, said soft plug portion comprising, at least, a channel formed therein;

linkage means for holding said plug means alternately between a first position when seals said passageway and a second position which does not seal said passageway, said channel of said soft plug portion interlocking with said bead of said passageway when said plug means is in said first position, whereby a seal is formed between the soft plug portion and said passageway; and said plug means further comprising, at least, a top plug portion constructed so as to overlap said passageway when said plug means is held in said first position and a sealing gasket mounted under said top plug portion to further seal said passageway when said plug means is held in said first position.

24. A resealable closure system for use on a container, which container includes at least an opening defined in a wall of the container, said closure system comprising:

an insert for mounting to the container wall within the opening, said insert including, at least, top and bottom surfaces and an inner wall forming a passageway which extends from said insert top surface to said insert bottom surface, said passageway including, at least, a bead protruding therefrom;

plug means for sealing said passageway, said plug means having a leading end and an opposite trailing end, and including, at least, a soft plug portion, said soft plug portion comprising, at least, a channel formed therein; and linkage means for holding said plug means alternately between a first position which seals said passageway and a second position which does not seal said passageway, said linkage means comprising, at least, a first path defining means for guiding said plug means leading end; and a second path defining means for guiding said plug means trailing end;

said first path defining means including, at least, two hinge arms, each mounted between said plug means leading end and said insert;

said second path defining means including, at least, two elongated plug guides attached to said insert on opposite sides of said passageway, a track in each plug guide, and guide pins mounted to said plug means trailing end, each guide pin positioned to engage with one of said tracks; and said channel of said soft plug portion interlocking with said bead of said passageway when said plug means is in said first position, whereby a seal is formed between the soft plug portion and said passageway.

25. Closure system of claim 24, further comprising keeper means for holding said plug means in said first position.

26. A resealable closure system for use on a container, which container includes at least an opening defined in a wall of the container, said closure system comprising:

an insert for mounting to the container wall within the opening, said insert comprising, at least, a top portion and a bottom portion, said insert bottom portion releasably attachable to said insert top portion to mount said insert to the container wall by clamping the container wall between said insert top portion and said insert bottom portion, said insert top portion including, at least, top and bottom surfaces and an inner wall forming a passageway which extends from said top surface of said insert top portion to said bottom surface of said insert top portion, said passageway including, at least, a bead protruding therefrom, plug means for sealing said passageway, said plug means including, at least, a soft plug portion, said soft plug portion comprising, at least, a channel formed therein; and linkage means for holding said plug means alternately between a first position which seals said passageway and a second position which does not seal said passageway, said channel of said soft plug portion interlocking with said bead of said passageway when said plug means is in said first position, whereby a seal is formed between the soft plug portion and said passageway.

27. Closure system of claim 26, wherein said insert further comprises, at least:

a flange channel in said insert top portion; and a flange corresponding to said flange channel, extending up from said insert bottom portion, so as to interact with said flange channel during mounting on the container wall.

28. Closure system of claim 27, wherein said insert further comprises, at least, a gasket separating said insert top portion and said insert bottom portion from the container.

29. A resealable closure system for use on a container, which container includes at least an opening defined in a wall of the container, said closure system comprising:

an insert for mounting to the container wall within the opening, said insert including, at least, top and bottom surfaces and an inner wall forming a passageway which extends from said insert top surface to said insert bottom surface, said passageway including, at least, a bead protruding therefrom;

plug means for sealing said passageway, said plug means including, at least, a soft plug portion, said soft plug portion comprising, at least, a channel formed therein;

linkage means for holding said plug means alternately between a first position which seals said passageway and a second position which does not seal said passageway, said channel of said soft plug portion interlocking with said bead of said passageway when said plug means is in said first position, whereby a seal is formed between the soft plug portion and said passageway;

a knob extending out from said inner wall of said insert; and a concave dimple on said soft plug portion located so as to engage with said knob when said plug means is in said first position.

30. A method for moving a plug between a first position within a passageway to a second position outside of the passageway, wherein the passageway defines a plane, said method comprising the step of:

simultaneously, lifting a first end of the plug above the plane defined by the passageway, moving a second, opposite end of the plug in a first linear direction parallel to the plane defined by the passageway, and moving a pivot area of the plug through a first arcuate path, above and about an axis lying parallel to the plane defined by the passageway.

31. Method of claim 30, further comprising the step of, simultaneously, guiding the first end of the plug through a second, generally arcuate path in a first angular direction while guiding the second, opposite end of the plug in a second direction away from the plane defined by the passageway and moving the pivot area of the plug farther along the first arcuate path, thus positioning the plug to a position beside the passageway.

32. An apparatus for controlled sealing of an opening in a container wherein the opening defines a plane, comprising:

plug means for selectively sealing the opening in the container, said plug means comprising, at least, a plug body for insertion into the opening, said plug body comprising, at least, a front end and a back end;

a first mounting member mounted to said plug means in the proximity of said plug body front end;

a second mounting member mounted to said plug means in the proximity of said plug body back end;

a force accepting segment mounted to said plug means for accepting a lifting force;

first mounting member guide means, attached to the container, for guiding said first mounting member through an arcuate path above and about an axis lying parallel to the plane defined by the opening, in response to movement of said force accepting segment; and second mounting member guide means, attached to the container, for guiding said second mounting member across the opening in response to movement of said force accepting segment;

whereby the movement of said plug means as it is moved between a position which seals the opening and a position which does not seal the opening will be controlled to follow a predefined path.

* * * * *